US006352788B1

(12) United States Patent
Bruce

(10) Patent No.: US 6,352,788 B1
(45) Date of Patent: Mar. 5, 2002

(54) THERMAL BARRIER COATING

(75) Inventor: Robert W. Bruce, Loveland, OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/511,007

(22) Filed: Feb. 22, 2000

(51) Int. Cl.[7] ..... B32B 15/04; F01D 5/28

(52) U.S. Cl. ..... 428/633; 428/472; 428/615; 428/622; 428/670; 416/241 B

(58) Field of Search ..... 428/615, 623, 428/633, 652, 670, 472; 416/241 R, 241 B

(56) References Cited

U.S. PATENT DOCUMENTS

| | | | | | |
|---|---|---|---|---|---|
| 4,399,199 | A | * | 8/1983 | McGill et al. | 428/633 |
| RE32,449 | E | * | 6/1987 | Claussen et al. | |
| 4,676,994 | A | | 6/1987 | Demaray | 427/42 |
| 4,774,150 | A | | 9/1988 | Amano et al. | 428/690 |
| 4,880,614 | A | | 11/1989 | Strangman et al. | 428/623 |
| 4,996,117 | A | | 2/1991 | Chu et al. | 428/633 |
| 5,981,088 | A | | 11/1999 | Bruce et al. | 428/633 |
| 6,042,898 | A | | 3/2000 | Burns et al. | 427/534 |

OTHER PUBLICATIONS

S. Stecura, "Effects of Compositional changes on the Performance of a Thermal Barrier Coating System," NASA Technical Memorandum 78976 (1976), no month.

* cited by examiner

*Primary Examiner*—Deborah Jones
*Assistant Examiner*—Jennifer McNeil
(74) *Attorney, Agent, or Firm*—Andrew C. Hess; David L. Narciso

(57) ABSTRACT

A thermal barrier coating (TBC) system for components designed for use in a hostile thermal environment, such as the turbine, combustor and augmentor sections of a gas turbine engine. The TBC system employs a thermal-insulating ceramic topcoat that is compatible with known metallic bond coats, such as diffusion aluminides and MCrAlY and NiAl coatings. The ceramic topcoat is formed of zirconia partially stabilized by about one up to less than six weight percent yttria and further stabilized by about one to about ten weight percent of magnesia and/or hafnia, to exhibit improved impact resistance.

14 Claims, 1 Drawing Sheet

THERMAL BARRIER COATING

FIELD OF THE INVENTION

The present invention relates to protective coatings for components exposed to high temperatures, such as components of a gas turbine engine. More particularly, this invention is directed to a thermal barrier coating system that includes a thermal-insulating ceramic layer with improved stability and impact-resistance at elevated temperatures, and lower density and thermal conductivity.

BACKGROUND OF THE INVENTION

The operating environment within a gas turbine engine is both thermally and chemically hostile. Significant advances in high temperature alloys have been achieved through the formulation of iron, nickel and cobalt-base superalloys, though components formed from such alloys often cannot withstand long service exposures if located in certain sections of a gas turbine engine, such as the turbine, combustor or augmentor. A common solution is to protect the surfaces of such components with a protective coating system, such as an aluminide coating or a thermal barrier coating (TBC) system. The latter includes an environmentally-resistant bond coat and a thermal barrier coating (TBC) of a ceramic material applied as a topcoat over the bond coat. Bond coats are typically formed of an oxidation-resistant alloy such as MCrAlY where M is iron, cobalt and/or nickel, or a diffusion aluminide or platinum aluminide. During high temperature excursions, these bond coats form an oxide layer or scale that chemically bonds the ceramic layer to the bond coat.

Zirconia ($ZrO_2$) that is partially or fully stabilized by yttria ($Y_2O_3$), magnesia (MgO), calcia (CaO), ceria ($CeO_2$) or other oxides has been employed as the ceramic material for the TBC. On occasion, combinations of oxides have been employed, as represented by U.S. Pat. No. 4,774,150 (zirconia stabilized by yttria, calcia and/or magnesia +$Bi_2O_3$, $TiO_2$, $Tb_4O_7$, $Eu_2O_3$ or $Sm_2O_3$ as a "luminous activator"). Yttria-stabilized zirconia (YSZ) is widely used as the insulating layer for TBC systems used in demanding applications because it exhibits desirable thermal cycle fatigue properties. In addition, YSZ can be readily deposited by air plasma spraying (APS), low pressure plasma spraying (LPPS), and physical vapor deposition (PVD) techniques such as electron beam physical vapor deposition (EBPVD). Notably, YSZ deposited by EBPVD is characterized by a strain-tolerant columnar grain structure, enabling the substrate to expand and contract without causing damaging stresses that lead to spallation.

As is known in the art, stabilization inhibits zirconia from undergoing a phase transformation (tetragonal to monoclinic) at about 1000° C. that would otherwise result in a detrimental volume expansion. Traditionally, zirconia for TBC systems has been stabilized with at least six weight percent yttria to avoid this transformation. In S. Stecura, "Effects of Compositional Changes on the Performance of a Thermal Barrier Coating System," NASA Technical Memorandum 78976 (1976), tests showed that plasma sprayed YSZ coatings containing six to eight weight percent yttria were more adherent and resistant to high temperature thermal cycling than YSZ coatings containing greater and lesser amounts of yttria. Contrary to the teachings of Stecura, in commonly-assigned U.S. Pat. No. 5,981,088 to Bruce et al., it was unexpectedly shown that if a YSZ coating has a columnar grain structure (e.g., deposited by EBPVD), superior spallation resistance can be achieved if zirconia is partially stabilized by less than six weight percent yttria.

Significantly, YSZ TBCs in accordance with Bruce et al. contain the monoclinic phase, which was intentionally avoided in the prior art by the six to eight weight percent yttria advocated by Stecura.

In addition to being resistant to spallation from thermal cycling, a thermal barrier coating on a gas turbine engine component is required to withstand damage from impact by hard particles of varying sizes that are generated upstream in the engine or enter the high velocity gas stream through the air intake of a gas turbine engine. The result of impingement can be erosive wear (generally from smaller particles) or impact spallation from larger particles. Accordingly, in addition to the greater spallation resistance from thermal cycling achieved with the teachings of Bruce et al., further improvements are desired for TBC materials. For example, greater impact resistance would also be desirable, as well as such other improvements such as lower density and lower thermal conductivity for more demanding applications at higher temperatures.

BRIEF SUMMARY OF THE INVENTION

The present invention provides a thermal barrier coating (TBC) system for components designed for use in a hostile thermal environment, such as the turbine, combustor and augmentor sections of a gas turbine engine. The TBC system is particularly suited for applications in which temperatures in excess of about 2000° F. (about 1090° C.) are encountered and induce severe thermal cycle fatigue stresses. The TBC system employs a thermal-insulating ceramic topcoat, or TBC, that is compatible with known metallic bond coats, such as diffusion aluminides and MCrAlY and NiAl coatings.

In particular, a TBC material in accordance with this invention is formed of zirconia partially stabilized by about one up to less than six weight percent yttria and further stabilized by about one to about ten weight percent of magnesia and/or hafnia. Furthermore, the TBC preferably has a columnar grain structure of the type produced when deposited by a PVD technique, preferably EBPVD.

TBC systems with the TBC material of this invention have been surprisingly shown to exhibit superior impact resistance as compared to conventional YSZ coatings containing more than six weight percent yttria. Importantly, prior art TBC systems have avoided zirconia stabilized by less than six weight percent yttria because such materials undergo a phase transformation that promotes spallation of the ceramic layer. Furthermore, prior art zirconia-based materials for TBC systems have typically been limited to a single stabilizing additive, primarily yttria or magnesia. However, in accordance with this invention, YSZ containing low levels of yttria in combination with magnesia and/or hafnia have been determined to exhibit improved impact resistance.

Other objects and advantages of this invention will be better appreciated from the following detailed description.

DETAILED DESCRIPTION OF THE INVENTION

The present invention is generally applicable to components that are protected from a thermally and chemically hostile environment by a thermal barrier coating (TBC) system. Notable examples of such components include the high and low pressure turbine nozzles and blades, shrouds, combustor liners and augmentor hardware of gas turbine engines. While the advantages of this invention are particularly applicable to gas turbine engine components, the teachings of this invention are generally applicable to any component on which a coating may be used to thermally insulate the component from its environment.

Figure 1:
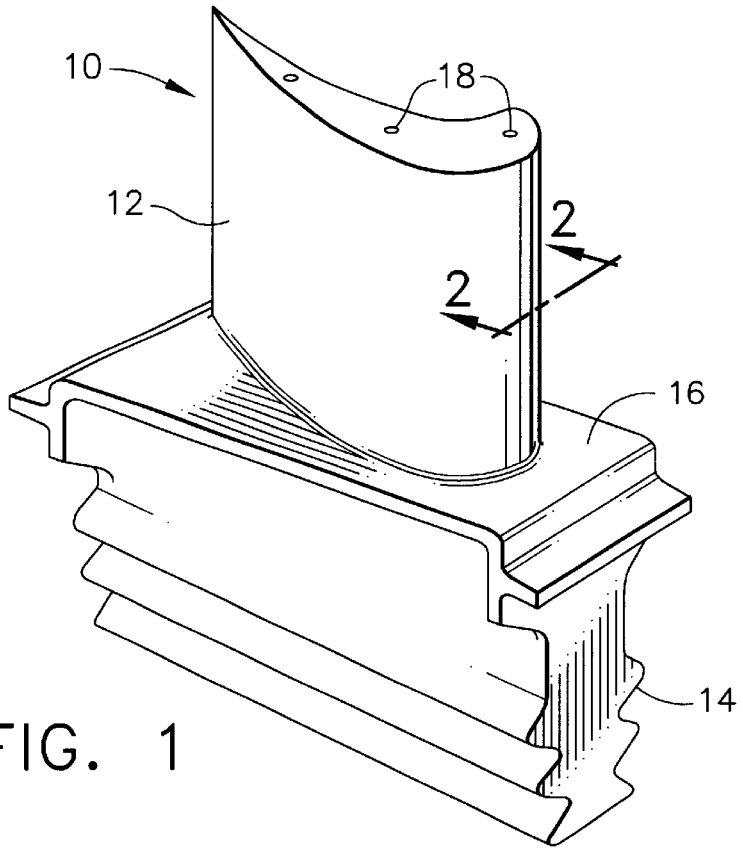
FIG. 1 is a perspective view of a high pressure turbine blade.

An example of a high pressure turbine blade 10 is shown in FIG. 1. The blade 10 generally has an airfoil 12 and platform 16 against which hot combustion gases are directed during operation of the gas turbine engine, and whose surfaces are therefore subjected to severe attack by oxidation, corrosion and erosion. The airfoil 12 is anchored to a turbine disk (not shown) with a dovetail 14 formed on a root section of the blade 10. Cooling holes 18 are present in the airfoil 12 through which bleed air is forced to transfer heat from the blade 10.

Figure 2:
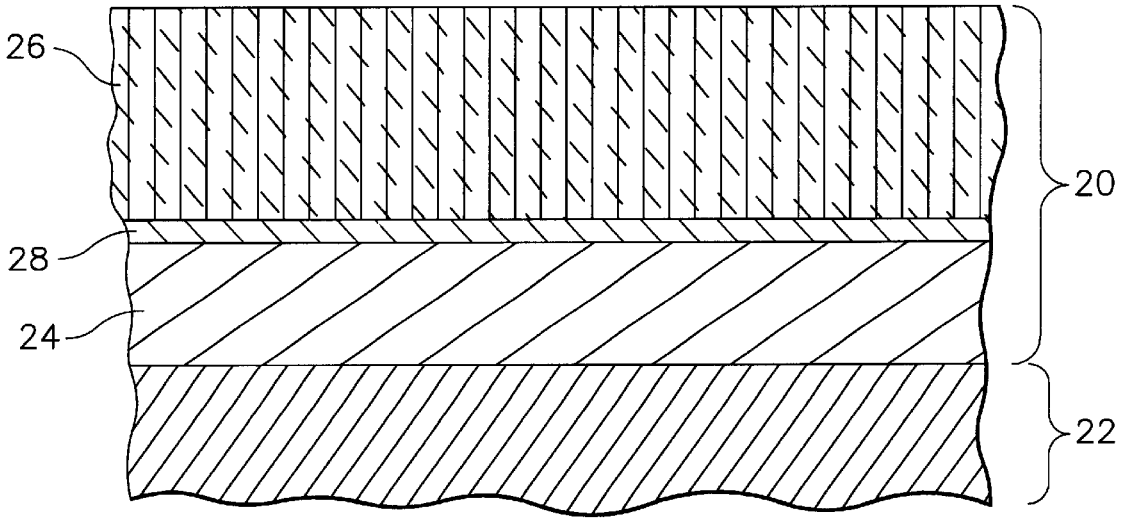
FIG. 2 is a cross-sectional view of the blade of FIG. 1 along line 2—2, and shows a thermal barrier coating system comprising a ceramic layer in accordance with this invention.

Represented in FIG. 2 is a thermal barrier coating system 20 in accordance with this invention. As shown, the coating system 20 includes a thermal-insulating ceramic layer (i.e., a thermal barrier coating, or TBC) 26 on a bond coat 24 that overlies a substrate 22, the latter of which is typically the base material of the blade 10. Suitable materials for the substrate 22 (and therefore the blade 10) include nickel and cobalt-base superalloys, though it is foreseeable that other materials could be used. As is typical with TBC systems for components of gas turbine engines, the bond coat 24 is preferably an aluminum-rich material, such as a diffusion aluminide or an MCrAlY or NiAl coating. These bond coat compositions are oxidation-resistant and form an alumina ($Al_2O_3$) layer or scale 28 on their surfaces during exposure to elevated temperatures. The alumina scale 28 protects the underlying superalloy substrate 22 from oxidation and provides a surface to which the ceramic layer 26 tenaciously adheres.

According to this invention, the material for the ceramic layer 26 is zirconia partially stabilized with about one up to less than six weight percent yttria, and further stabilized by about one to about ten weight percent of magnesia and/or hafnia ($HfO_2$). Preferred compositions for the ceramic layer 26 are about three weight percent yttria and three weight percent of either magnesia or hafnia, the balance being essentially zirconia. These oxide combinations have been shown to yield a ceramic layer 26 with improved impact resistance as compared to zirconia stabilized with yttria alone. In addition, magnesia, which has often been used to stabilize zirconia grinding media, has the added advantage of lowering the density of the ceramic layer 26, while hafnia has the benefit of a very high melting point (about 2812° C.). Finally, hafnia has a lower coefficient of thermal conductivity than zirconia, and therefore helps to improve the thermal insulating effect of the ceramic layer 26.

The ceramic layer 26 is preferably characterized by a strain-tolerant columnar grain structure, as represented in FIG. 2. The columnar grain structure is attained by depositing the ceramic layer 26 on the bond coat 24 using a physical vapor deposition technique, and preferably EBPVD. However, it is possible that suitable results could be obtained by depositing the ceramic layer 26 using other known processes, such as air plasma spraying (APS) and low pressure plasma spraying (LPPS).

During an investigation leading to this invention, erosion and impact tests were performed on nickel-base superalloy pin specimens (about 6 mm diameter) having a zirconia layer stabilized by either four weight percent yttria (4% YSZ) or seven weight percent yttria (7% YSZ), the latter being representative of the industry standard YSZ coating material. Also tested were 4% YSZ specimens further stabilized by three weight percent of either magnesia (4% YSZ+3% MgO) or hafnia (4% YSZ+3% $HfO_2$). The nickel-base superalloy was René N5, having the following nominal composition in weight percent: 7.5 cobalt, 7.0 chromium, 1.5 molybdenum, 5.0 tungsten, 3.0 rhenium, 6.5 tantalum, 6.2 aluminum, 0.15 hafnium, 0.05 carbon, 0.004 boron, with the balance nickel and incidental impurities. The YSZ layers were deposited by EBPVD to a thickness of about 0.005 inch (about 125 micrometers) on platinum aluminide bond coats. All of the YSZ coatings were characterized by a columnar grain structure as a result of the EBPVD deposition process. While the 7% YSZ coating was characterized by a fully tetragonal phase, the 4% YSZ coatings were characterized by having the monoclinic phase in a tetragonal matrix.

The impact and erosion tests served to measure the relative performance of coatings at high temperatures (1230° C.) and high gas velocities (Mach 0.5) when subjected to an alumina powder injected into the gas stream. Powders with average particle sizes of about 50 micrometers and about 560 micrometers were used to evaluate erosion and impact resistance, respectively. The specimens were rotated at a rate of about 500 rpm while subjected to the high velocity alumina powder. investigation. Erosion and impact resistance were measured in terms of the number of grams of erodent required to break through the thermal barrier coating to the underlying bond coat. Erosion and impact resistance for each specimen evaluated are reported in Table I below.

TABLE I.

| Specimen (Coating) | Erosion Specimens | | Avg. | Impact Specimens | | Avg. |
|---|---|---|---|---|---|---|
| 7%YSZ | 700 | 700 | 700 | 1000 | 900 | 950 |
| 4%YSZ | — | 800 | 829 | 1700 | 1800 | 1775 |
| | 800 | 900 | | 1500 | 1900 | |
| | 700 | 800 | | 1800 | 1400 | |
| | 900 | 900 | | 2000 | 2100 | |
| 4%YSZ + 3%MgO | 900 | 800 | 850 | 1900 | 2000 | 1950 |
| 4%YSZ + 3%$HfO_2$ | 800 | 800 | 800 | 2000 | 2000 | 2000 |

From the above, it can be seen that the 4% YSZ+3% MgO and 4% YSZ+3% $HfO_2$ specimens exhibited about 100% greater impact resistance than the 7% YSZ specimen, exhibited a significant improvement in impact resistance over the other 4% YSZ specimens. In terms of erosion resistance, the 4% YSZ+3% MgO and 4% YSZ+3% $HfO_2$ specimens exhibited better resistance than the 7% YSZ specimen, and were comparable to the other 4% YSZ specimens.

During a subsequent investigation, furnace cycle tests were performed on four Rene N5 specimens having zirconia layers stabilized by seven weight percent yttria (7% YSZ), and three Rene N5 specimens with zirconia layers partially stabilized by about 3 weight percent yttria and about 3 weight percent hafnia (3% YSZ+3% $HfO_2$). The coatings were deposited by EBPVD to a thickness of about 0.005 inch (about 125 micrometers) on platinum aluminide bond coats deposited by vapor phase deposition. All of the coatings were characterized by a columnar grain structure as a result of the EBPVD deposition process. The test was conducted at a temperature of about 2075° F. (about 1135° C.), and continued until about 20% spallation of the coating occurred. The 3% YSZ+3% $HfO_2$ specimens exhibited an average life of about 560 cycles, as compared to 535 cycles for the standard 7%YSZ specimens. From this, it was concluded that the 3% YSZ+3% $HfO_2$ specimens of this invention were capable of a comparable if not slightly better thermal cycle fatigue life.

From the tests reported above, it was concluded that a columnar zirconia-based TBC containing three to four weight percent yttria and about three weight percent of magnesia or hafnia would exhibit improved impact resistance over 4% YSZ and conventional 7% YSZ coatings under hostile thermal conditions. From these tests, it is believed that levels of about one up to less than six weight percent yttria columnar in combination with about one to about ten weight percent of magnesia and/or hafnia would also exhibit improved impact resistance.

While the invention has been described in terms of a preferred embodiment, it is apparent that other forms could be adopted by one skilled in the art. For example, MCrAlY and NiAl bond coats could be used, and the thickness of the TBC could vary from that tested. Therefore, the scope of the invention is to be limited only by the following claims.

What is claimed is:

1. A thermal barrier coating system on a surface of a component the thermal barrier coating system comprising a thermal-insulating layer that has a columnar grain structure and that consists of zirconia partially stabilized by about one up to less than six weight percent yttria and further stabilized by about one to about ten weight percent of magnesia or hafnia.

2. A thermal barrier coating system according to claim 1, wherein the thermal-insulating layer contains about 3 to 4 weight percent yttria and about 3 weight percent magnesia.

3. A thermal barrier coating system according to claim 1, wherein the thermal-insulating layer contains about 3 weight percent yttria and about 3 weight percent magnesia.

4. A thermal barrier coating system according to claim 1, wherein the thermal-insulating layer contains about 3 to 4 weight percent yttria and about 3 weight percent hafnia.

5. A thermal barrier coating system according to claim 1, wherein the thermal-insulating layer contains about 3 weight percent yttria and about 3 weight percent hafnia.

6. A thermal barrier coating system according to claim 1, further comprising a metallic bond coat adhering the thermal-insulating layer to the component.

7. A thermal barrier coating system according to claim 6, wherein the metallic bond coat is a diffusion platinum aluminide.

8. A thermal barrier coating system according to claim 1, wherein the component is an airfoil component of a gas turbine engine.

9. A thermal barrier coating system on a surface of an airfoil component of a gas turbine engine, the thermal barrier coating system comprising:

a metallic bond coat on the surface of the airfoil component; and a thermal-insulating layer having a columnar grain structure and consisting of zirconia partially stabilized by about one up to about four weight percent yttria and further stabilized by about three weight percent of magnesia or hafnia.

10. A thermal barrier coating system according to claim 9, wherein the thermal-insulating layer contains about 3 to 4 weight percent yttria and about 3 weight percent magnesia.

11. A thermal barrier coating system according to claim 9, wherein the thermal-insulating layer contains 3 weight percent yttria and 3 weight percent magnesia.

12. A thermal barrier coating system according to claim 9, wherein the thermal-insulating layer contains about 3 to 4 weight percent yttria and about 3 weight percent hafnia.

13. A thermal barrier coating system according to claim 9, wherein the thermal-insulating layer contains 3 weight percent yttria and 3 weight percent hafnia.

14. A thermal barrier coating system according to claim 9, wherein the metallic bond coat is a diffusion platinum aluminide.

* * * * *